United States Patent [19]

Goyau et al.

[11] Patent Number: 4,646,985

[45] Date of Patent: Mar. 3, 1987

[54] APPARATUS FOR WINDING AND UNWINDING A CABLE OF WHICH ONE END MAKES ELECTRIC CONTACT WITH A FIXED INSTALLATION

[75] Inventors: Gilles Goyau, Chalon-sur-Saone; Jean-Claude Rimaire, Givry, both of France

[73] Assignee: Framatome, Courbevoie, France

[21] Appl. No.: 816,774

[22] Filed: Jan. 7, 1986

[30] Foreign Application Priority Data

Jan. 7, 1985 [FR] France ..... 85 00143

[51] Int. Cl.[4] ..... B65H 49/02

[52] U.S. Cl. ..... 242/54 R; 242/128; 242/129

[58] Field of Search ..... 242/54 R, 82, 83, 128, 242/129, 85; 191/12.2 R, 12.2 A, 12.4 R

[56] References Cited

U.S. PATENT DOCUMENTS

| | | | |
|---|---|---|---|
| 2,223,005 | 11/1940 | Kerber | 15/104.3 |
| 2,730,740 | 1/1956 | O'Brien | 15/104.3 |
| 2,953,799 | 9/1960 | Arnold | 15/104.3 |
| 3,039,715 | 6/1962 | Caperton | 242/82 |
| 3,077,314 | 2/1963 | Caperton | 242/54 R |
| 3,298,051 | 1/1967 | Ratliff | 15/104.3 |
| 3,928,885 | 12/1975 | Peterson et al. | 15/104.3 SN |
| 4,258,834 | 3/1981 | Hawley et al. | 242/82 X |
| 4,471,651 | 9/1984 | Dimeff et al. | 73/40.5 R |

FOREIGN PATENT DOCUMENTS

| | | |
|---|---|---|
| 877765 | 1/1980 | Belgium . |
| 829193 | 6/1938 | France . |
| 2519761 | 2/1985 | France . |
| 2002179 | 2/1979 | United Kingdom . |
| 2096102 | 10/1982 | United Kingdom . |

*Primary Examiner*—John M. Jillions
*Assistant Examiner*—David Werner
*Attorney, Agent, or Firm*—Pollock, Vande Sande & Priddy

[57] ABSTRACT

Apparatus for winding and unwinding a cable of which one end makes electric contact with a fixed installation. The cable (6) has one end which makes electric contact with a fixed installation (18). It is wound on the peripheral portion of a fixed plate (15). A duct (17) fastened to a shaft (24) mounted for rotation relative to the plate (15) effects the winding and unwinding of the cable onto and from the fixed plate (15). The shaft (24) is returned by a spring in the cable unwinding direction. The semi-rigid cable (6) acts on the duct (17) to turn it in the winding direction. The duct (17) in which the cable passes has a curvature suitable for being subjected to the thrust of the cable.

5 Claims, 6 Drawing Figures

APPARATUS FOR WINDING AND UNWINDING A CABLE OF WHICH ONE END MAKES ELECTRIC CONTACT WITH A FIXED INSTALLATION

FIELD OF THE INVENTION

The invention relates to an apparatus for winding and unwinding a cable of which one end makes electric contact with a fixed installation.

BACKGROUND OF THE INVENTION

It is often necessary to make checks in an industrial plant in order to determine the evolution undergone by materials of which certain parts of the plant are made, or in order to check that no sensitive parts show signs of dangerous deterioration. It may be necessary to make these checks at a distance because the parts requiring checking are not accessible or because the conditions prevailing in the industrial plant are dangerous to an operator.

For example, when the tubes of steam generators in pressurized water nuclear reactors are checked, it is necessary to operate at a distance from outside the steam generator and beneath its water tank. Checking steam generator tubes in a pressurized water nuclear reactor generally consists in introducing ultrasonic or eddy current probes into the tubes, these probes transmitting the results of their measurements through cables of great length, of which the end not connected to the probe is in electric contact with an apparatus processing the measurement signals.

These cables generally consist of a number of conductors transmitting different measurement signals to the apparatus processing these signals.

The movement of the probes inside the plant being checked, for example inside the tubes of a steam generator, is very often effected by a pushing or pulling action applied to a part of the cable situated outside the installation. This pushing or pulling action may be applied by hand with the aid of an electromechanical control unit called a puller-pusher. The cable has sufficient rigidity to allow pulling or pushing forces to be transmitted to its end carrying the probe.

The opposite end portion of the cable to that carrying the probe is generally wound on a reel of cylindrical shape, which makes it possible to reduce the risk of mechanical damage to the cable and kinking, which could result in a blockage.

The end of the cable which has to make electric contact with the measurement signal processor shares in the rotation of the reel, so that it is necessary to use multitrack rotating connections, each of the conductive tracks corresponding to one measuring conductor. The construction of these connectors gives rise to technical problems which are difficult to solve, and makes it necessary to select suitable materials for ensuring good transmission of the signals. The cost of these connectors is therefore high. In addition, the use of these connectors makes it necessary to take special precautions, which are not always sufficient to avoid all risk of parasites. These parasites, superimposed on the measurement signals and due in particular to bad contact between the brushes and the tracks of the connectors, may give rise to measurement errors resulting in unsatisfactory checks.

Cable winding and unwinding devices have been proposed, in which one end of the cable remains fixed, so that the use of a rotating connector is not required.

Devices of this kind cannot, however, be applied to a cable moved by pushing and pulling.

Devices are also known for winding wires, particularly wire rods, which comprise a cylindrical wire receiver casing and a guide duct through which the wire passes. This guide duct carries the wire to the peripheral part of the casing in which the wire is wound. The cylindrical casing is rotated about its axis, so that the relative rotational movement between the casing and the guide duct carrying the wire enables the wire to be wound inside the casing. Nevertheless, a device of this kind has never been used in the case of a measurement cable moved by pushing and pulling, and in addition it would not make it possible to receive the measurement signals in a simple manner.

SUMMARY OF THE INVENTION

The invention therefore proposes an apparatus for winding and unwinding a cable, of which one end makes electrical contact with a fixed installation, which apparatus comprises a plate having a peripheral portion on which the cable can be wound and a duct guiding the cable to the peripheral portion of the plate, the cable being engaged upstream of the duct, i.e., on the opposite side to the plate, with a pushing and pulling means effecting the movements of the cable, and a relative rotational movement being made between the plate and the duct in order to wind or unwind the cable, this apparatus making it possible to effect the winding or unwinding of the cable under good conditions and without the use of rotating connectors.

To this end, the plate is fixed and the guide duct is fastened to a shaft mounted for rotation relative to the plate and directed along an axis at right angles to the plate in its central portion, corresponding to the winding axis of the cable, the shaft being connected to a return means for the rotation about the winding axis so as to turn it in the direction corresponding to the unwinding of the cable, while the guide duct is so shaped that its projection in a plane perpendicular to the winding axis will be curved and have a convex portion directed in the cable winding direction, so that the pushing of the cable in order to wind it brings about the rotation of the guide duct against the action of the return means.

BRIEF DESCRIPTION OF THE DRAWINGS

In order that the invention may be more clearly understood, a description will now be given, with reference to the accompanying drawings, of one embodiment of construction of the cable winding and unwinding apparatus according to the invention, applied to a measuring cable of which one end is connected to a probe for checking the steam generator tubes of a pressurized water nuclear reactor.

In these drawings.

DETAILED DESCRIPTION

Figure 1:
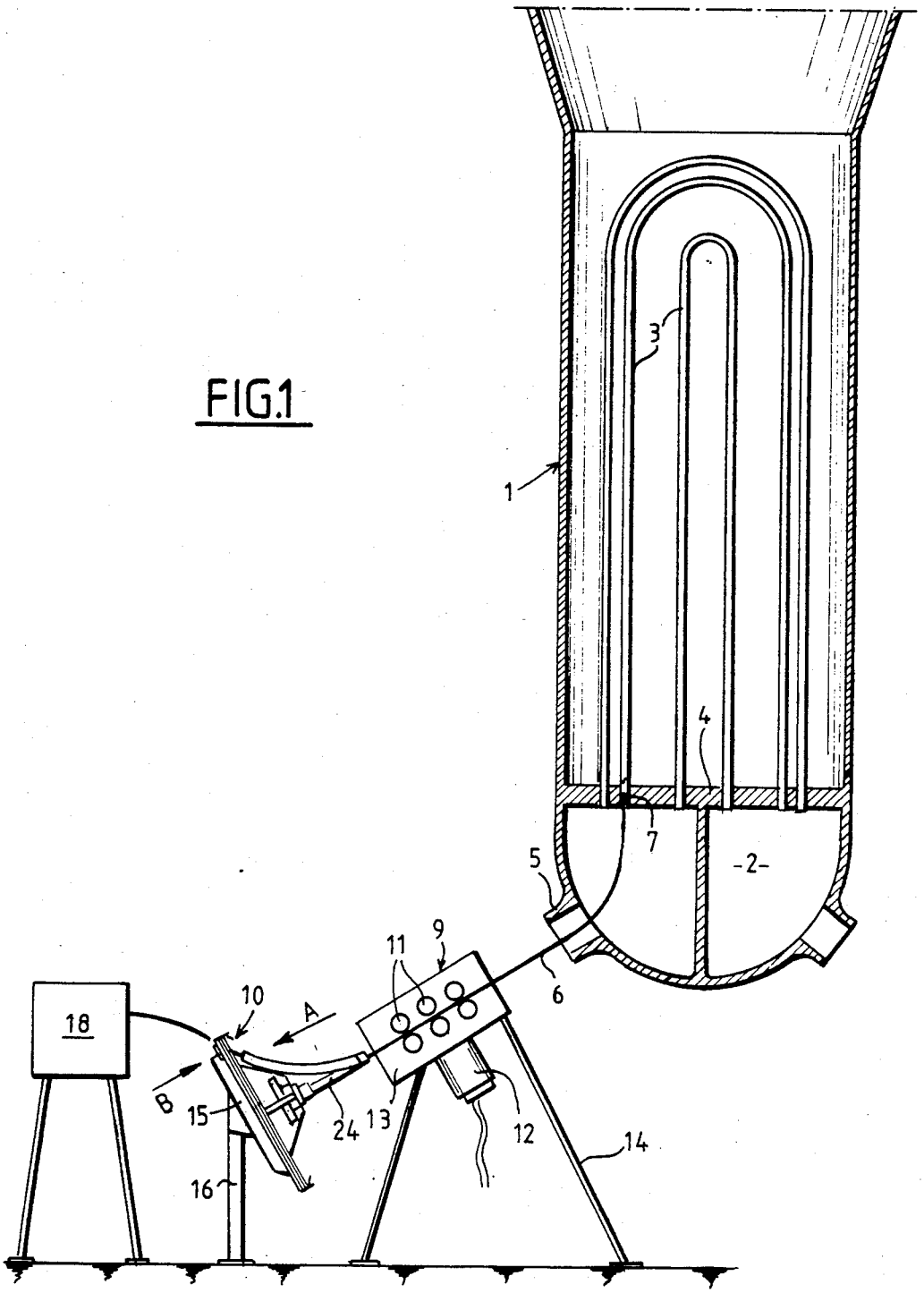
FIG. 1 is a view in section through a vertical plane of a steam generator in which a check is made on the tubes.

FIG. 1 shows the lower part 1 of a steam generator comprising the water tank 2, the bank of tubes 3, and the tube plate 4 through which the bottom parts of the tubes of the bank 3 pass.

In order to check the tubes, a cable 6 is introduced through an opening 5 in the water tank, this cable carrying at its end a probe 7 which can be introduced in succession into each of the tubes of the bank through one of its ends. The probe 7 can be moved inside the tube with the aid of an arrangement comprising a puller-pusher 9 and the cable winder-unwinder 10.

The puller-pusher device comprises in known manner an arrangement of rollers 11 driven in one direction or the other by a motor 12, inside a casing 13 carried by a stand 14.

The cable winder-unwinder apparatus 10, which will be described in greater detail with reference to FIGS. *2a, 2b* and *2c*, comprises a plate 15 intended to receive the cable and fastened rigidly to a stand 16, and a guide duct 17 into which the cable 6 passes at the outlet of the puller-pusher 9. The guide duct 17 has one end near the periphery of the support plate 15, where the cable is distributed for winding onto or unwinding from the plate 15. The guide duct has a slot along the inner generatrix 17*b* of the bend of the duct 17. This slot 17*b* facilitates the introduction of the probe and its cable, the rigidity of which prevents it from easily following the shape of the guide duct 17. The puller-pusher 9 is situated slightly upstream of the other end of the guide duct 17, which constitutes its inlet end.

The opposite end of the cable to that where the probe 7 is disposed is fixed on the plate 15 and connected to an apparatus 18 processing the measurement signals transmitted through the cable 6. The connection between the end of the cable and the apparatus 18 entails no problem, since the plate 15 is fixed.

FIGS. *2a, 2b* and *2c* show the cable winder-unwinder apparatus 10, in which the fixed plate 15 carries in its central portion a frustoconical support 20 whose axis is the axis X—X′ of the circular plate 15, which corresponds to the winding axis of the cable 6. The support 20 carries a ball bearing arrangement 22, in which a shaft 24 directed along the axis X—X′ is mounted for rotation. The guide duct 17 is fastened to one end of the shaft 24. The other end of this shaft 24 penetrates into a casing 25 fastened to the support 20. Inside the casing 25 the end of the shaft 24 is fastened to the central end of a spiral spring 26, the other end of which is rotationally fixed in the casing 25. The winding direction of the spiral spring 26 and its mounting in the casing 25 are such that this spring tends to drive the shaft 24 and the duct 17 in the direction of the arrow 27 in FIG. *2a*, i.e., the unwinding direction of the cable 6. The spring 26 therefore constitutes a means of returning the shaft 24 and the duct 27 in the cable unwinding direction. A stop 29 provided with a locking pin makes it possible to lock the shaft 24 against rotation in order to prevent the unwinding of the spring when the winder is not in operation.

The cable 6 is wound into the peripheral portion of the fixed support 15 and forms successive turns as shown in FIGS. *2c, 3a* and *3b*.

When the cable is pulled with the aid of the device 10, the guide duct 17 therefore tends to precede the displacement of the cable through the action of the spring 26 driving the shaft 24 rotationally about the axis X—X′ in the cable unwinding direction. The unwinding of this cable is therefore facilitated by the action of the duct 17.

When the cable is pushed with the aid of the device 9, it will, because of its rigidity, apply a thrust to the inner surface of the duct 17 in its portion 17*a* visible in FIG. *2a*. The duct 17 is in fact so shaped that both its projection onto a plane containing the winding axis X—X′, as visible in FIG. *2c*, and its projection onto a plane perpendicular to this axis X—X′, as visible in FIG. *2a*, shows a curvature effecting the guiding of the cable.

The curvature in an axial plane, as visible in FIG. *2c*, makes it possible to guide the cable towards the peripheral part of the support 15, where the winding takes place.

The curvature in a plane perpendicular to the axis X—X′, as visible in FIG. *2a*, is such that the guide duct 17 has on the outside a convex portion 17*a* directed in the direction of the arrow 28 corresponding to the cable unwinding direction. When the cable is wound by pushing, it applies a thrust to the duct 17 in its portion 17*a*, thus tending to turn it in the direction of the arrow 28. The rotation of the duct 17 makes it possible to effect the distribution of the cable in order to wind it into the peripheral part of the support 15. The thrust force applied by the rigid cable 6 to the duct 17 is sufficient to turn the duct 17 against the action of the spiral spring 26, the compression of which increases during the winding of the cable.

The movements of the cable 6, both in the unwinding direction and in the winding direction, are thus facilitated by the duct 17, which prevents any deformation or entangling of the cable.

Figure 2C:
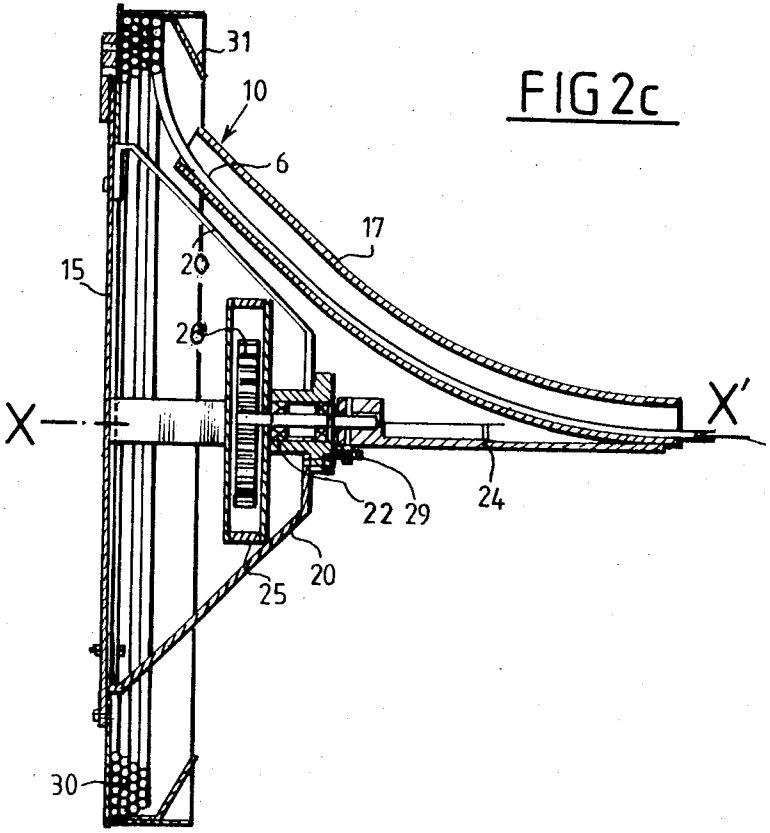
FIG. 2*c* is a section on the line C—C in FIG. 2*a;*
Figure 2A:
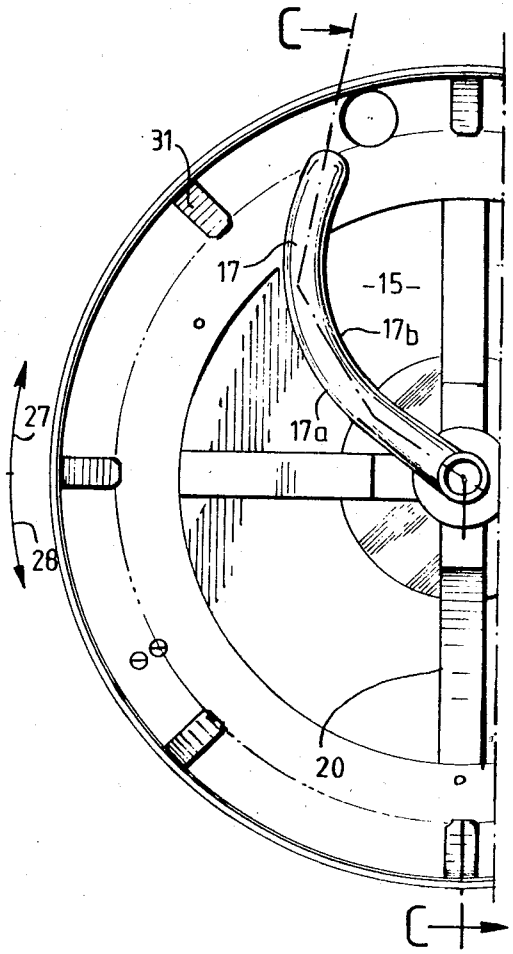
FIG. 2*a* is a half-view, in the direction A in FIG. 1, of the winder-unwinder apparatus.
Figure 2B:
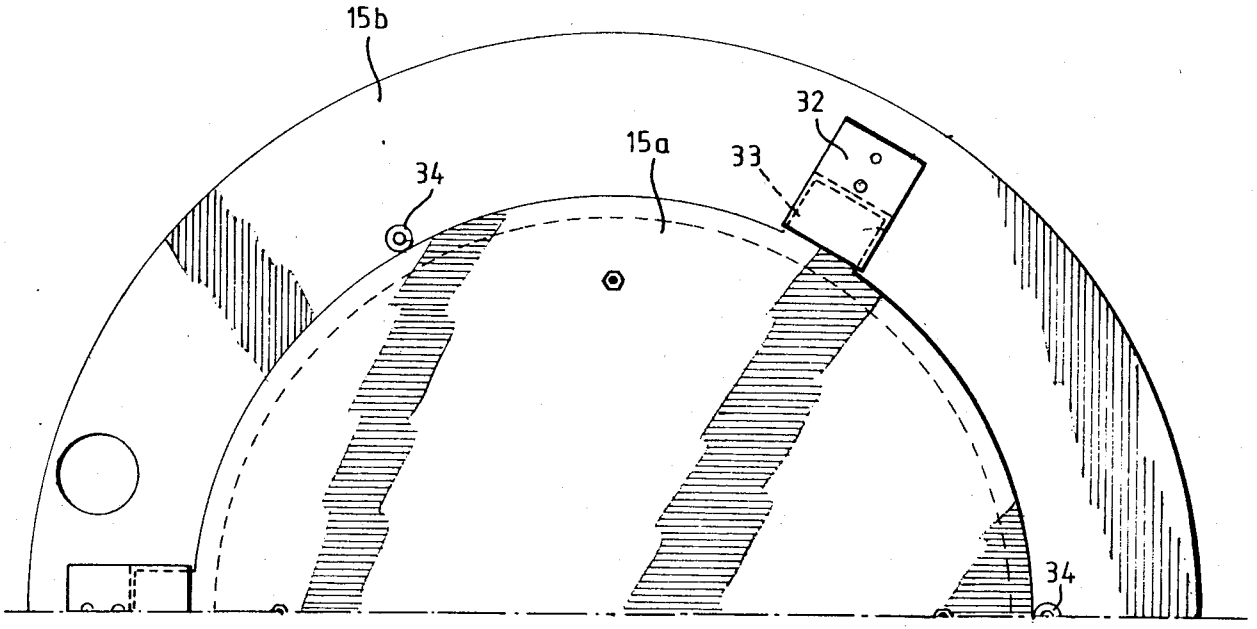
FIG. 2*b* is a half-view, in the direction B in FIG. 1, of the cable winder-unwinder.
Figure 3B:
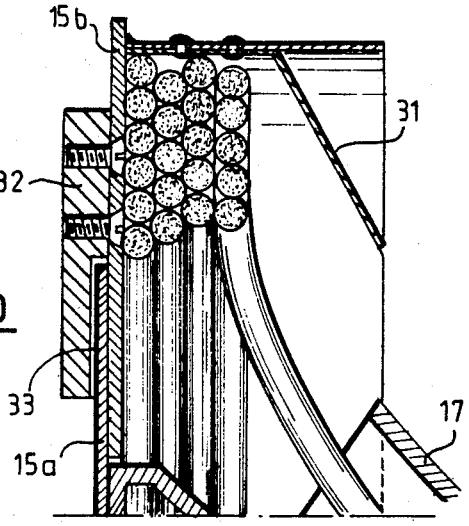
FIG. 3*b* is an enlarged view of the detail B in FIG. 2*c.*
Figure 3A:
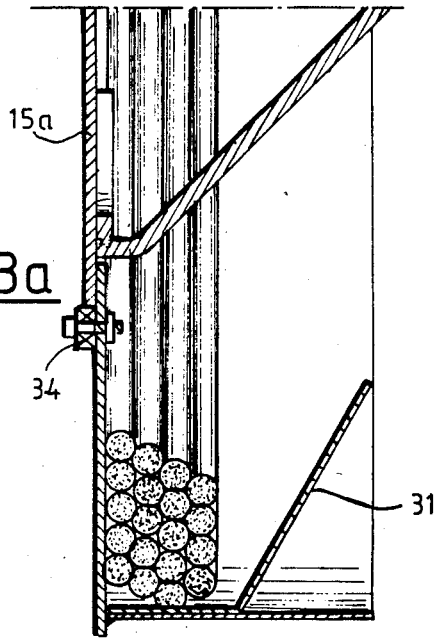
FIG. 3*a* is an enlarged view of the detail A in FIG. 2*c;*

A description will now be given, with reference to both FIG. 2 and FIG. 3, of the structure and mounting of the plate 15, which comprises a central portion 15*a* in the form of a disc rigidly fastened to the stand 16, and a peripheral portion 15*b* in the form of a crown surrounded externally by a rim 30 on which are fixed lugs 31 holding the cable wound into the peripheral portion 15*b* of the plate 15.

The portions 15*a* and 15*b* of the plate 15 are joined together by means of a bayonet device comprising three lugs 32 fixed at 120° from one another on the crown 15 and three projecting parts 33 of the disc 15*a*. As can be seen in FIGS. *2b* and *3a*, three ball bearings 34 are disposed at 120° from one another on the crown 15*b*, in such a manner that their outer ring is in contact with the outer edge of the disc 15*a*.

The crown 15*b* can thus easily be turned around the disc 15*a*. The ball bearings 34 serve both as mechanical stops and as means facilitating the rotation of the crown relative to the disc. This rotation enables the projections 33 to be disengaged from the lugs 32 in order to separate the crown on which the cable is wound from the disc fastened to the stand, or on the contrary to enable these two parts to be joined together again, whereupon they will be fastened together by forced engagement of the lugs 32 on the projection 33, the thickness of which is slightly greater than the thickness of the disc 15*a*.

The cable wound on the peripheral portion of the plate 15 can thus easily be separated from the central portion of this plate, which is fastened to the stand. It is also possible for the cable wound inside the peripheral portion 15*b* to be very easily placed on the central portion 15*a* fastened to the stand, for the purpose of starting a checking operation in the steam generator.

The principal advantages of the winding and unwinding apparatus according to the invention are thus the avoidance of any deformation or entangling of the cable with a simple device comprising a fixed plate receiving the cable and enabling one end of the cable to be easily connected to a measurement signal processing apparatus. In addition, the apparatus uses only the pushing force of the cable and the tensile force of a spring to rotate the guide duct of the winder.

Finally, the two-part construction of the cable receiving plate makes it possible for the cable wound on the winder-unwinder to be very easily placed in position.

The invention is not limited to the embodiment which has been described.

Thus, a different construction of the cable receiving plate can be conceived. The duct may have a shape different from that described, provided that this duct is subjected to a cable thrust sufficient to turn it, against the action of the spring, in the cable winding direction.

Finally, the winding and unwinding apparatus according to the invention can be used not only for checking steam generators, but also for checking of any heat exchanger used in a nuclear reactor or in another application, or else in the case of any checking operation in industrial installation zones access to which is difficult.

What is claimed is:

1. Apparatus for winding and unwinding a cable (6) of which one end makes electric contact with a fixed installation (18), said apparatus comprising a plate (15) having a peripheral portion (15*b*) onto which the cable is wound, a duct (17) for guiding the cable (6) to the peripheral portion of the plate (15), a pushing and pulling means (9) upstream of the duct for effecting movements of the cable, said plate and said duct adapted for relative rotation in order to wind and unwind the cable (6) from the peripheral portion of the plate, wherein said plate (15) is fixed, and further comprising a shaft (24), said guide duct (17) being fastened to the shaft for rotation relative to the plate (15), said shaft extending along an axis (XX') which is perpendicular to the central portion of the plate (15), said cable being wound about said axis, a return means connected to the shaft for rotating the shaft about said axis (XX') so as to unwind the cable from the peripheral portion of the plate, the guide duct (17) being shaped such that its projection in a plane perpendicular to said axis (XX') is curved, said guide duct having a convex portion (17*a*) directed in the winding direction (28), so that the pushing of the cable (6) by the pushing and pulling means winds the cable upon the peripheral portion of the plate, said pushing and pulling means rotating the guide duct (17) against the action of the return means (26).

2. An apparatus according to claim 1, wherein the return means (26) is a spiral spring.

3. An apparatus according to claim 2, further comprising a means (29) for locking the shaft (24) against rotation in order to prevent the unwinding of the spiral spring (26) when the apparatus is not in use.

4. An apparatus according to any one of claims 1 to 3, wherein the plate (15) has a central portion (15*a*) in the form of a disc, said disc being fastened to a fixed support (16), said plate further having a peripheral portion (15*b*) in the form of a crown having means (30, 31) for holding the wound cable (6), the disc (15*a*) and the crown (15*b*) being connected by means of a bayonet device consisting of parts (33) projecting relative to the disc (15*a*) and of lugs (32) fastened to the crown (15*b*), the crown (15*b*) being mounted for rotation on the edge of the disc (15*a*) with the aid of ball bearings (34) for assembling the disc and the plate.

5. An apparatus according to any one of claims 1 to 3, wherein the cable (6) carries at one end a probe (7) for checking the tubes of a steam generator (1) of a pressurized water nuclear reactor.

* * * * *